US011109695B1

(12) United States Patent
Jorgensen

(10) Patent No.: US 11,109,695 B1
(45) Date of Patent: Sep. 7, 2021

(54) PICTURE FRAMING HARDWARE COMPONENT

(71) Applicant: Keith Jon Jorgensen, Stoughton, MA (US)

(72) Inventor: Keith Jon Jorgensen, Stoughton, MA (US)

( * ) Notice: Subject to any disclaimer, the term of this patent is extended or adjusted under 35 U.S.C. 154(b) by 0 days.

(21) Appl. No.: 17/020,669

(22) Filed: Sep. 14, 2020

(51) Int. Cl.
*A47G 1/06* (2006.01)

(52) U.S. Cl.
CPC .... *A47G 1/0611* (2013.01); *A47G 2001/0677* (2013.01)

(58) Field of Classification Search
CPC ..... A47G 1/10; A47G 2001/0677; A47G 1/0611
See application file for complete search history.

(56) References Cited

U.S. PATENT DOCUMENTS 4,348,826 A * 9/1982 Reim ..... A47G 1/10 40/782
2005/0016047 A1* 1/2005 Yamagishi ..... A47G 1/10 40/782
2013/0180142 A1* 7/2013 Kressin ..... A47G 1/06 40/792

* cited by examiner

*Primary Examiner* — Gary C Hoge

(57) ABSTRACT

A one piece inexpensive essentially universal compressive loading type hardware component that is quickly installed/uninstalled particularly designed for clamping a variety of common objects, e.g.; photos, canvas paintings, books, etc. directly onto the back of a common mat board comprising an appropriately sized aperture to provide a popular sized border within many common popular back-loading off-the-shelf picture frame assemblies with or without glaze. In particular, installing at least two said hardware components is required for complete installation eliminating need for other type fasteners to complete the assembly. More particular, adjusting art object location is easily performed by sliding said art object laterally under load of said hardware component due to the effective distribution of compressive loads to secure said assembly while mitigating risk of damage to said art object, mat and frame as well as employing a particular manufacturing process to mitigate risk of fatigue.

7 Claims, 19 Drawing Sheets

PICTURE FRAMING HARDWARE COMPONENT

BACKGROUND OF INVENTION

There are many types of picture framing hardware components. In particular, the invention addresses the common type leaf spring design that generates compression force to hold picture frames, glaze and mat and art objects together. In particular, compressive forces are created when the hardware component is captured between the picture frame shell component and one or more of the other components depending upon the customer requirements.

The most simple version concerns inserting a glaze panel and an art object in a polygonal frame shell configured with a rabbet and dado slot combination intended to accept a common leaf spring type hardware component. Often these types of picture frame assemblies are purchased in standard sizes ready to accept standard size graphic prints and photos or particular sized common items that might be considered art. In particular, the same hardware components used to hold the glaze to the frame are removed, the art inserted face down on the glaze whereby its edges extend to the inside of the frame dado and the hardware components are reinserted so as to press the art object and captured within the slot in the fame shell creating opposing forces which secure the assembly with the art object in place. This assembly requires no back cover component but one may be added if preferred.

A more complicated but most popular scenario involves a picture frame assembly wherein a mat configured with a cut-out slightly smaller than the size of the art object is introduced as a user requirement. In particular, the artwork dictates the cut-out size in the mat and the mat border around the art dictates the size the mat which dictates the size the frame shell dado must be configured to while the glaze size matches the mat size. Assembly normally involves the glaze and mat inserted into the shell followed by the art object face down. The art object is specifically located for a particular viewing requirement and then attached securely to the back side of the mat using some type of secondary hardware component other than the primary component which holds the frame shell, mat and glaze in place. Therefore, to reiterate, this type of assembly requires an additional hardware component specifically to secure the art object to the mat for required viewing. In particular, when mounting the art object to the mat, it is often necessary to measure and specifically locate the art object prior to fastening so as to ensure final viewing location/position is satisfactory.

Often a rigid back panel is inserted as part of the assembly system. In particular, the back panel becomes the component onto which the hardware component contacts and provides pressure as it is compressed between the back panel and the frame shell. More particular, back panels are often configured with integrally mounted hardware components that snap and or pivot into place capturing said back panel and said shell by which to exert compression force necessary to hold said assembly together. Other common methods used to secure art objects and backing panels include nails, staples and points.

Many off-the-shelf picture frame products are particularly configured to mount popular art objects like photos, certificates, posters, calendars, books, magazines, music media sleeves and even dinner plates. However, being dedicated they lack versatility which limits the user's options which reduces demand which increases cost.

Adhesive hardware is often used to effectively mount art objects to mat boards and/or frames. Locating corner holders is very tedious and removing the adhesive can be difficult, time consuming and risk damaging components. Again dedication of art objects can be prohibitive.

Some mat boards are configured with dedicated corners, pockets and or sleeves into which the art object can be placed/secured. Often these type mat products can be put into a standard or custom frame or hung on the wall as is. The extra material and manufacturing adds cost while again dedication limits the user's options.

Not found by the inventor's search were mass produced leaf spring type hardware components configured specifically to provide both the primary function of fastening mat and or glaze to the frame shell and the secondary function of securing the art object to the mat while interfacing the shell independently. Meaning extra hardware adds cost and labor.

Another concern is that locating or re-locating the artwork during assembly is often time consuming and/or costly. More particular, a mistake requires disassembly, relocating and reassembly adding more time, cost, risks damage to components and of course causes frustration often leading to more mistakes.

Another common condition of most of the off-the-shelf frames is that they are restrictive to mount relatively thin art prints—e.g.; photos or posters etc.; accommodating thicker and/or heavier art objects is essentially not possible or at least not easily facilitated.

Common off-the-shelf specialty frames dedicated to mount album covers, magazines and playbills, etc., by do-it-yourselfers often do not incorporate mats, limiting the aesthetic appeal of the presentation.

Common leaf spring type hardware components made of steel share the same problem. In particular, they are designed and manufactured from one piece of material. By design, the force generated when compressed and installed into the frame assembly is often a great amount of force to keep the art object or glaze/mat in place. However, that great force often causes damage (e.g.; dent) to the component it contacts or causes unwanted visual characteristics when the art is viewed from the front. In addition, the component's material chemical composition needs to be acid-free to protect art objects from being adversely affected. Therefore, the design and the material properties cause problems in picture framing. The high cost to fabricate intricate configurations in steel or other materials is relatively high and therefore often prohibitive in the highly competitive picture frame industry. It's common to use plastic injection molded parts to meet complex design requirements and reduce cost, however the particular requirements for picture framing hardware components using compression force make plastic components unfeasible due to fatigue and deformation caused by being under compression for long periods of time which eventually cause failure of the picture frame assembly.

SUMMARY OF INVENTION

It is an object of this invention to provide a multifaceted picture framing hardware component that uses compression force to safely, quickly and easily secure popular art objects of all types such as photos, certificates, posters, calendars, books, magazines and music CD's, records/sleeves, canvas oil paintings, dinner plates, T-shirts, archived stacks of paper documents, etc., within many common off-the-shelf and custom back load picture frame assemblies comprising a common frame shell, mat and glaze.

It is a further object of this invention to make it possible to easily, quickly and inexpensively adapt all common shell materials: wood, composite, metallic and/or plastic having an integral dado i.e.; slot and rabbet configured to an appropriate depth of which is common in off-the shelf and custom picture frame extrusion moldings of which shells are configured. Additionally, should a frame shell have only a rabbet in that no dado slot exists, a second hardware component such as a common staple can be inserted halfway into the shell to create a step/slot feature into which the invention can be inserted. In particular, the ends of the long leaf springs are configured with a small vertical rib which, when inserted into said slot feature provide the primary support generating the opposing force necessary for the invention to be secured and perform as required.

It is a further object of this invention to simultaneously make contact with a plurality of components in a picture frame assembly comprised of a frame shell, art object mat and glaze. More particular, the invention shall contact the shell multiple times, the art object multiple times and the mat at least once in one embodiment and can obviously be configured to contact the mat multiple times in a second or third embodiment by adding additional appendages extending from the body of the invention component.

It is a further object of this invention to mitigate risk of imperfection and damage (e.g.; dents) to art objects or mat components by managing the applied forces using laws of physics in its design. In particular, while the total force applied to hold the objects together is very great—as is required to hold heavy objects in place, the force per square inch exerted onto the components contacted is relatively low so as not to distort the art object. More particular, the high force generated by the longer spring Latches that contact the shell are transmitted to the large body surface area contacting the artwork resulting in a low force per square inch value which contributes to mitigation of risk of damage to the artwork. Further in particular, a plurality of compliant leaf spring type appendages extend from that body to contact the art object and the mat providing forces that effectively clamp down the art object to the mat which in turn clamps the glaze to the frame shell. Anti-rotation and equilibrium are direct results of the force management design.

It is a further object of this invention to mitigate risk of plastic deformation under compressive load by infusing steel into its plastic substrate employing common insert molding and/or over-molding processes.

It is a further object of the invention to eliminate the need to specifically locate the art object before assembly. In particular, the art object—after assembly and while under full load—will be re-positioned by sliding it around, side to side, up and down or diagonally to suit the user's requirements as viewed from the front as a result of the aforementioned force management design technique.

It is a further object of this invention to mitigate risk of scratching the art object by applying polished finishes on the edges and surfaces that contact the art object. In particular Ejector pin witness lines are recessed below the surface that contacts the art object.

It is a further object of this invention to integrate features to aid hanging the frame assembly vertically.

It is a further object of this invention to ensure that it shall be installed into and removed from picture frame assemblies easily and quickly with no adverse effects to other components.

It is a further object of this invention to accommodate Art objects of a wide range of thickness limited only by the depth of the shell's rabbit slot. It is a further object of this invention to accommodate art objects of relatively light and heavy weight without risk of damage.

Thus, the invention results from the realization that a sole multifaceted picture framing hardware component applying high compression force can be made inexpensively and equally effective at safely securing a wide range of popular art objects behind a mat in a wide range of standard off-the-shelf and custom picture frame assemblies, wherein easy fast location, removal and interchanging of art objects is afforded by simply applying laws of physics to provide efficient force management. In particular, this invention is a picture framing hardware component particularly engineered to generate a high compressive load and distribute said load to said art object thru a large body structure to mitigate risk of damage. More particular, said body comprises a plurality of leaf spring appendages, particularly a pair of latches that capture said picture frame shell to produce said compressive force while another appendage contacts/applies force to said mat while more appendages contact/apply force to said art object resulting in a system of opposing forces that maintain system equilibrium and contain objects effectively while mitigating risk of damage.

DETAILED DESCRIPTION OF THE PREFERRED EMBODIMENTS

Figure 1:
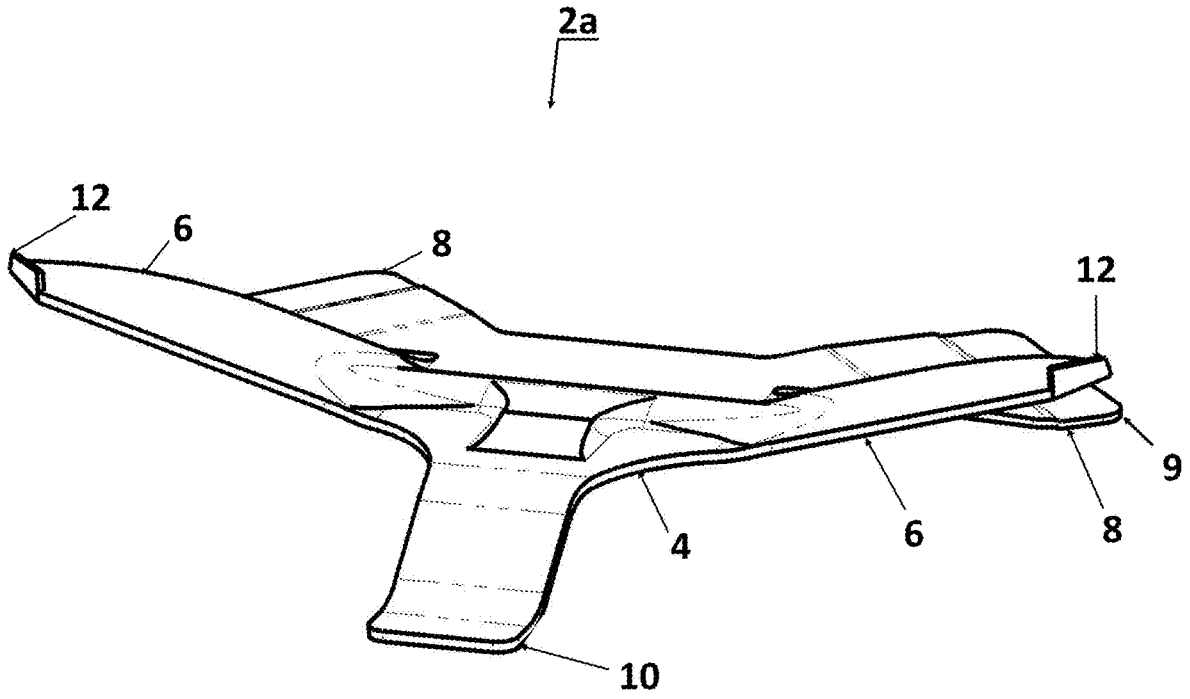
FIG. 1 is an isometric view of a picture framing hardware component according to this invention.
Figure 2:
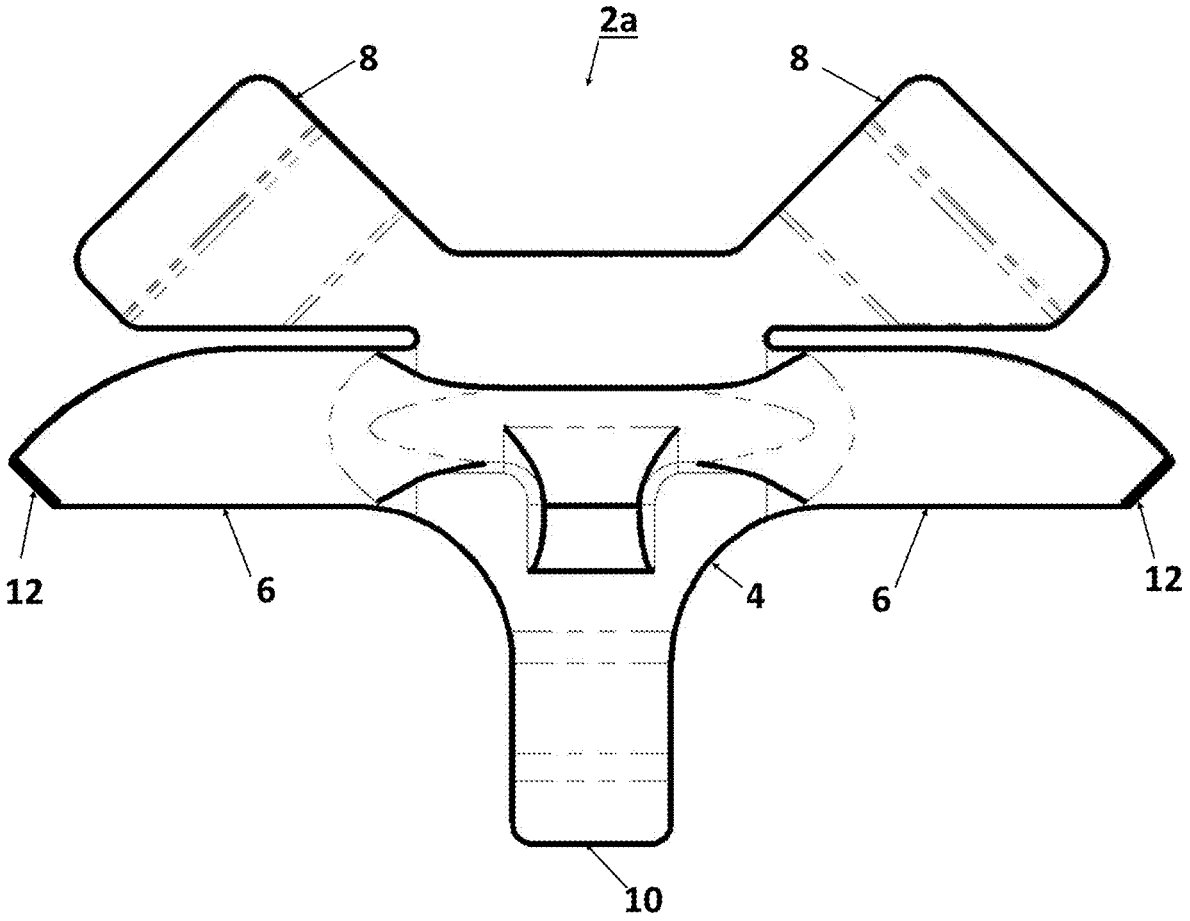
FIG. 2 is a top plan view of the component of FIG. 1.
Figure 3:
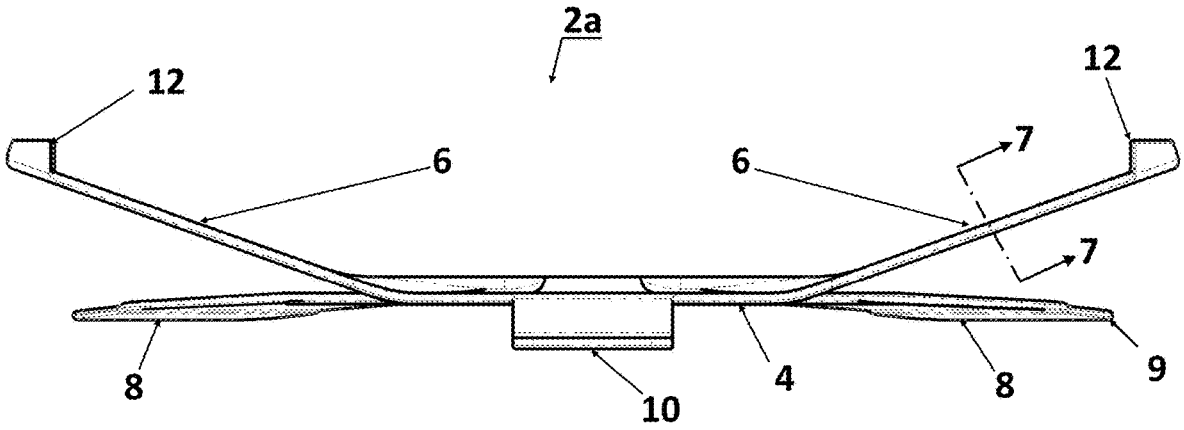
FIG. 3 is a front elevational view of the component of FIGS. 1 and 2

With reference to FIG. 1, a picture framing hardware component 2*a* in accordance with the invention particularly comprises a rigid main support body 4 that which is integrally configured with a plurality of flexible appendages including leaf spring latches 6, compliant pads 8, and a leaf spring tongue 10. More particular, there is a vertical rib 12 integrally configured at the distal end of each said latch.

Figure 4:
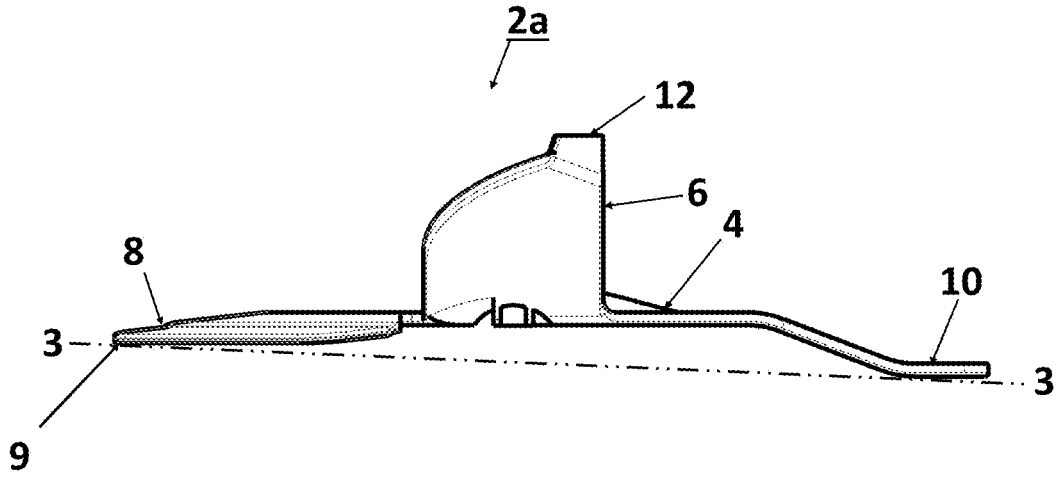
FIG. 4 is a side elevational view of the component of FIGS. 1, 2 and 3.

Said picture framing hardware component, is manufactured in a relaxed or more particularly, a static state whereof when placed on a surface it should rest only on said tongue and each said pad, more particularly on rear edge 9 of each said pad of which provides a specific three-point contact as is most easily identified in FIG. 4 wherein ref line 3-3 represents a surface upon which said hardware component may be placed for inspection, as an example. Further in particular, said manufactured configuration provides effective support strength and balance when said component is stacked i.e.; nested with a plurality of components. More further in particular, said three-point contact provides opportunity for a quick and easy quality inspection procedure whereof a rocking motion, when particularly tested by an installer, should indicate a warped part is in hand which can then be most effectively dispositioned according to procedure. Even further in particular, said nesting capability promotes efficient warehousing, shipping, high volume assembly part picking, retail packaging and attractive point of purchase displays.

Figure 5:
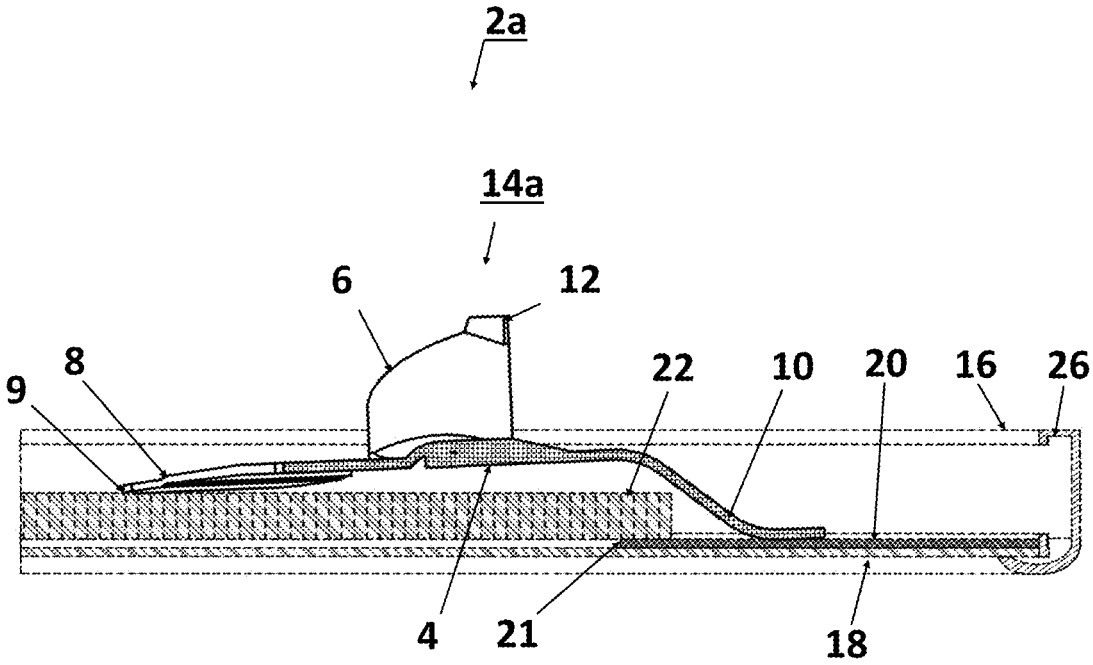
FIG. 5 is an elevational view, in partial section depicting the component of FIGS. 1, 2, 3 & 4 along line 9-9 in FIG. 11 according to this invention.
Figure 7:
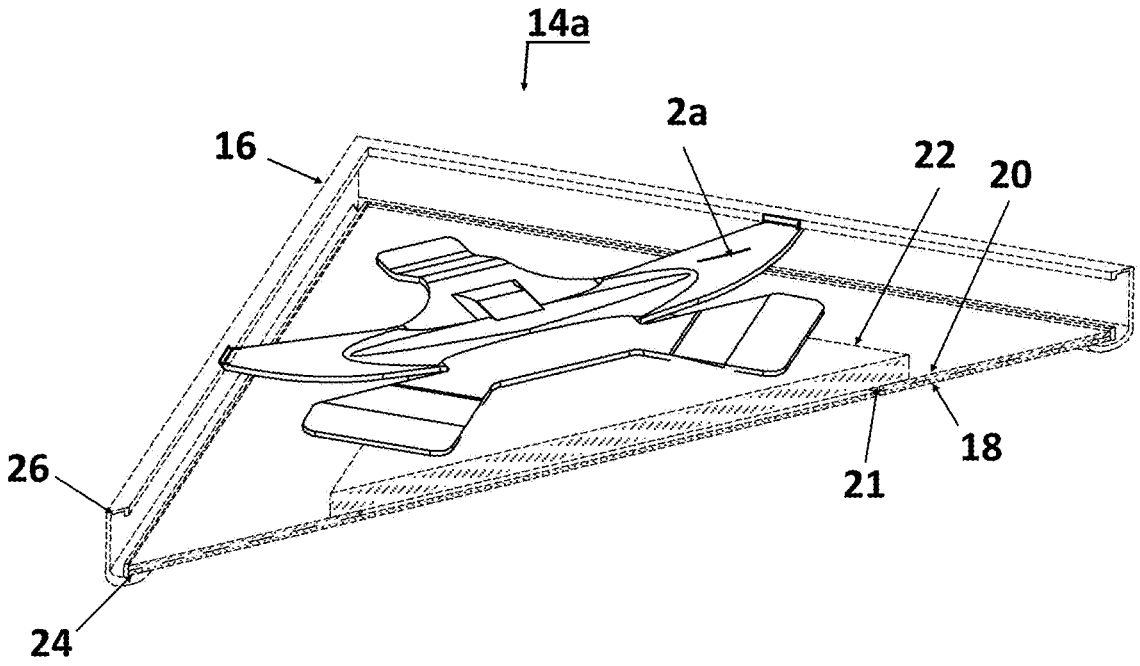
FIG. 7 is an isometric detail view in section depicting the component of FIGS. 1, 2, 3 & 4 along line 17-17 in FIG. 11 wherein said component is depicted fully installed within a picture frame assembly wherein identified as Step 3 of the installation process according to this invention.
Figure 8:
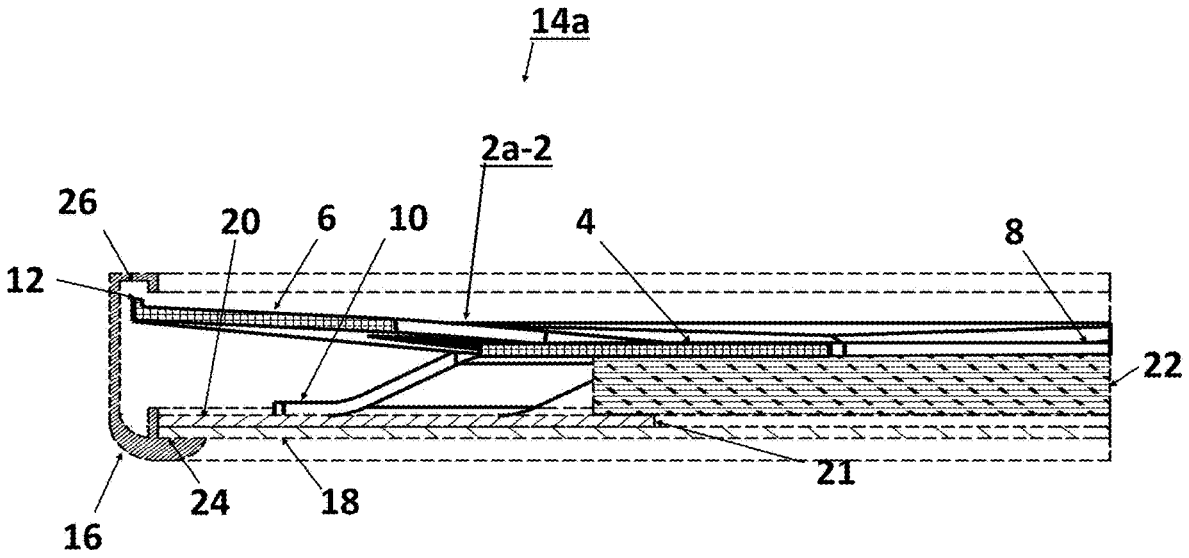
FIG. 8 is an elevational view, in partial section depicting the component of FIGS. 1, 2, 3 & 4 along line 11-11 in FIG. 11 wherein said component is depicted in simulation of a particular installed condition wherein component is particularly identified as 2-*a*-2 according to this invention.
Figure 11:
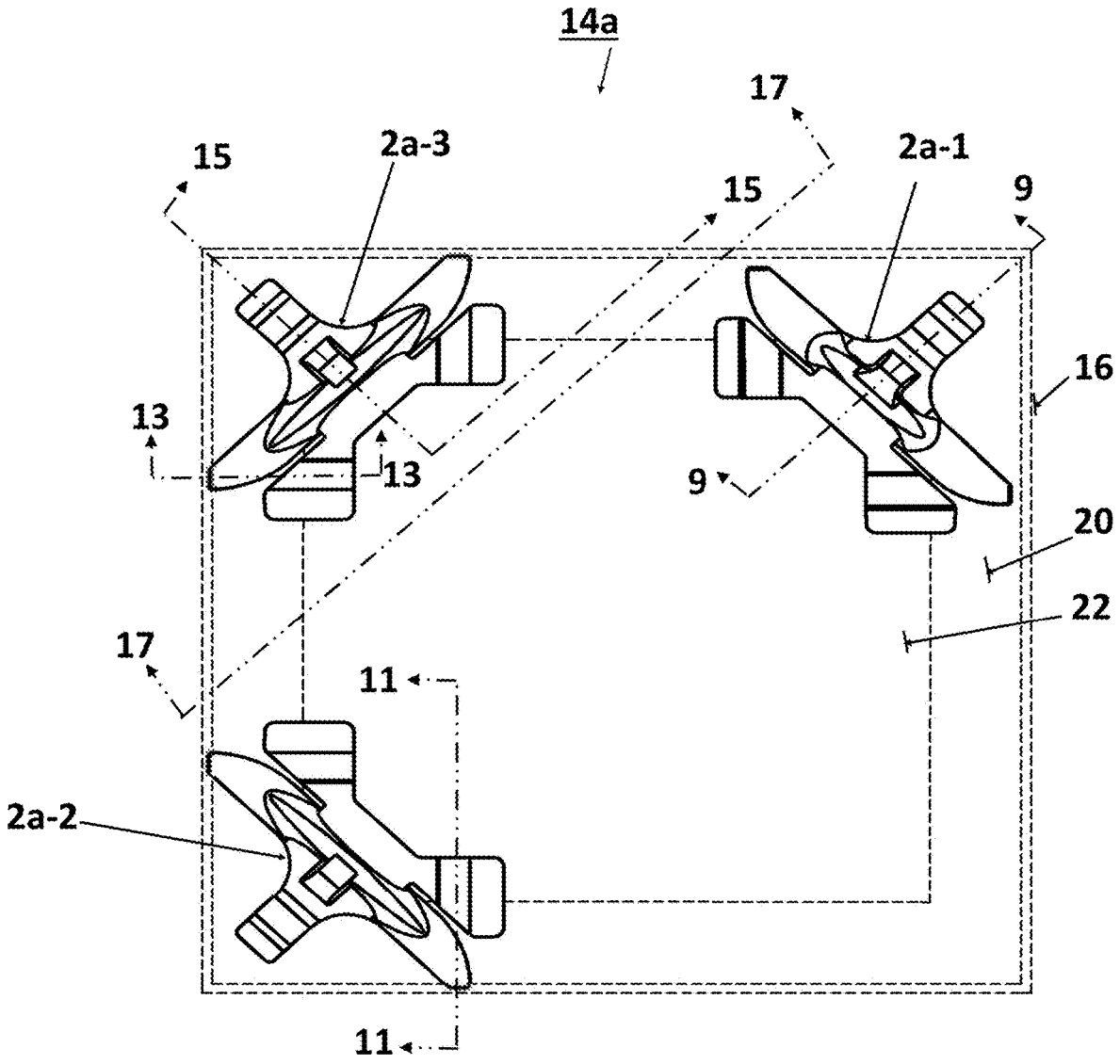
FIG. 11 is a plan view of a picture frame assembly wherein the component of FIGS. 1, 2, 3 and 4 is depicted proximate to 3 of the 4 corners to provide a particular reference according to this invention.
Figure 12:
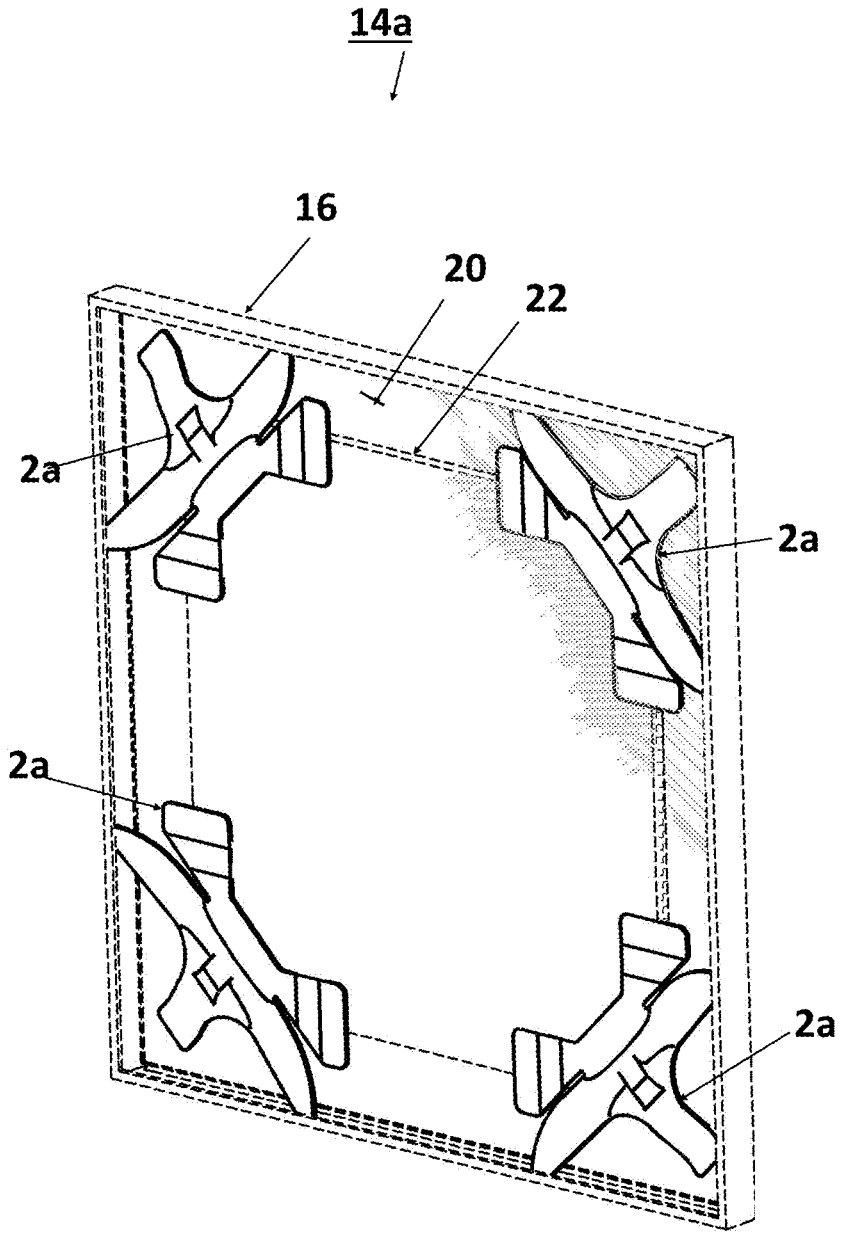
FIG. 12 is an isometric view of a picture frame assembly wherein the component of FIGS. 1, 2, 3 and 4 is depicted fully installed in each corner of a typical picture frame assembly according to this invention.

With reference to FIG. 12, said picture frame assembly embodiment 14*a* is configured with one each said hardware component installed proximate each corner of said embodiment. To create said embodiment, or one similar thereof a particular three step procedure should be followed to achieve successful installation of said hardware component as is shown in FIG. 7, an isometric view taken along line 17-17 in FIG. 11. Particularly, said installation procedure changes said condition of said hardware component from its initial said relaxed/static state of condition to a particular dynamic state of condition. With further reference to FIG. 11, said three step installation procedure process is simulated wherein each condition of each step: set up and insert and captured are simulated and respectfully referenced thus that said set-up condition correlates to cutting line 9-9 thru hardware component 2-*a*-1 and depicted in FIG. 5; said insert condition correlates to cutting line 11-11 thru hardware component 2-*a*-2 and depicted in FIG. 8 and said capture condition correlates to cutting line 13-13 thru hardware component 2-*a*-3 and depicted in FIG. 9. With particular reference to FIG. 5 said hardware component is depicted in said set up condition not unlike said static condition wherein more particularly each said latch distal end is positioned with respective said rib located proximate high above said shell; said tongue rests on mat and said rear edge of each pad rest on said art object, essentially resembling said 3 point contact position. With particular reference to FIG. 8, said hardware component is depicted in said insert condition. In particular, said hardware component is shown in a temporary compressed condition caused by installer applying an effective force using thumb and middle finger of one hand to simultaneously depress each latch downward such that each rib is sufficiently located proximate below wall of said dado thus to then allow sliding said component in direction of said shell rabbit past said dado wall such that said rib is position proximate below aligned to said dado as depicted. More particular, said applied force generates sufficient compressive load within said component which should be distributed thru said body onto said art object and said tongue compressed onto said mat and said pads essentially flattened onto said art object—each applying a particular amount of force relative to change in elevation. Particular force and load relationships shall be addressed further within this specification.

Figure 9:
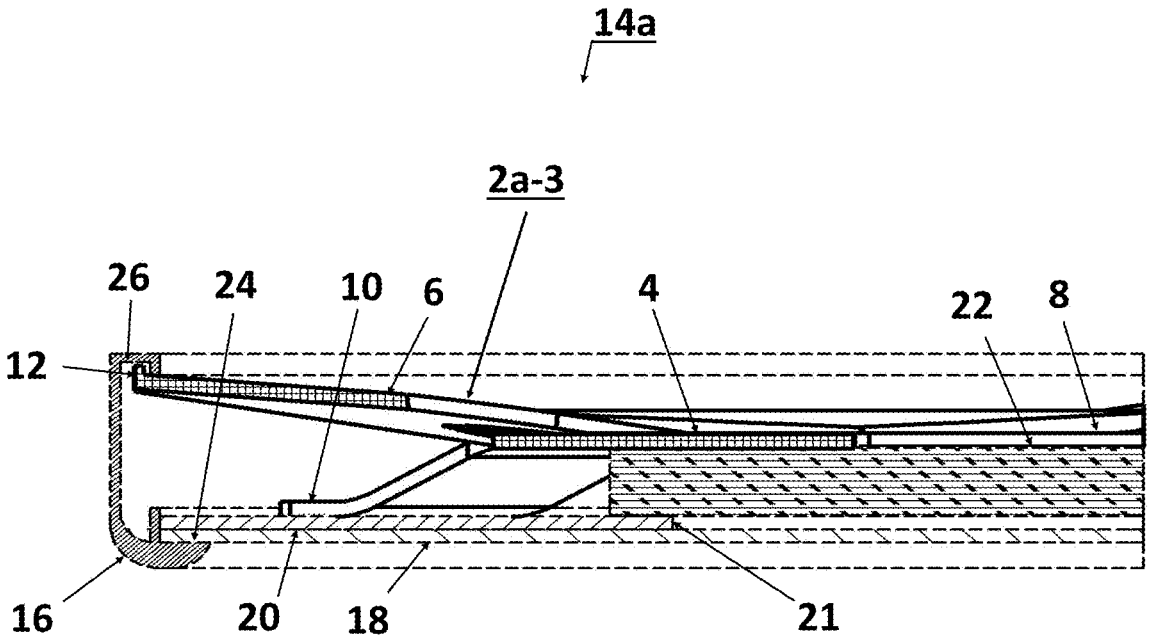
FIG. 9 an elevational view, in partial section depicting the component of FIGS. 1, 2, 3 and 4 along line 13-13 in FIG. 11 wherein said component is depicted in simulation of a particular installed condition wherein component is particularly identified as 2-*a*-3 according to this invention.

Upon attaining above said insert condition, installer shall release said latches allowing each to ascend upward till each said latch contacts underside of said shell dado wall and thus with each respective rib effectively captured within said dado as is depicted in FIG. 9. With particular reference to FIG. 9, said captured condition results in said hardware component adjusting slightly from said insert condition to said final captured condition, albeit a very minor change in condition other than said location of said rib. With said hardware component remaining compressed in its final installed condition said body continues to distribute an effective load onto said art object with said tongue complying to make intimate contact with and effectively distributing an independent load to said mat and each said pad independently complying to make intimate contact with and effectively distributing an independent load to said art object. To remove said hardware component from assembly, the process is simply reversed. In particular, said installer depresses said latches 6 simultaneously so as said ribs 12 descend proximate below said dado wall as depicted in FIG. 8 allowing installer to then slide said component away from said shell so as to allow said latches to ascend upward to which point said component returns to static condition most like that depicted in FIG. 5.

Figure 10:
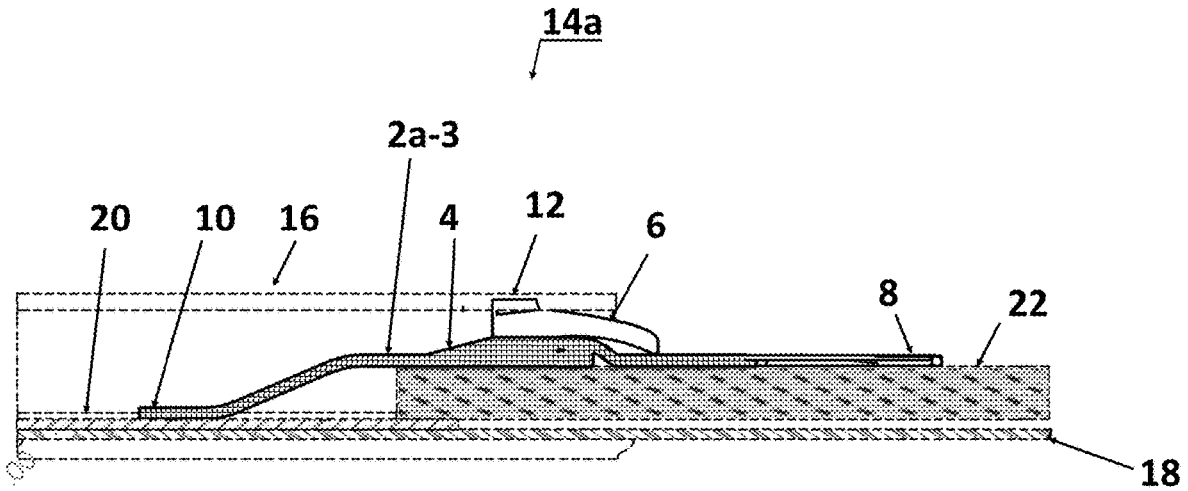
FIG. 10 is an elevational view, in partial section depicting the component of FIGS. 1, 2, 3 and 4 along line 15-15 in FIG. 11 wherein said component is depicted in simulation of a particular installed condition wherein component is particularly identified as 2-*a*-3 according to this invention.

The true spirit of the invention lies in the dynamic performance characteristics of the picture frame hardware component. Thus it is essential to understand the particular change in condition from static to dynamic and the corresponding relationships between force generation and transmission and load distribution through said hardware component onto said art object and beyond into said picture frame assembly so as to maintain equilibrium within said assembly over a long period of time. Therefore particular said conditions and relationships shall be particularly disclosed herein with reference to said installation procedure and FIGS. 5, 7, 8, 9, 10, and 11 as required for clarity. In particular, the invention is depicted as installed in its final captured dynamic condition within a picture frame assembly as depicted in FIG. 12. With reference to installation process, component 2*a* is first introduced in its static state as is depicted in FIG. 5. Upon compressing each said leaf spring latch 6 of said component 2*a* and inserting it into final position as depicted as 2*a*-3 in FIG. 11 as labeled 2*a*-3 said component is held in said captive/final/dynamic state of condition. In said captured state, particularly between said shell 16 and said art object 22 said particular predetermined compressive force is generated within said hardware component creating said compressive force. The result being said compressive load shall be directly transmitted from said latches 6 to said body 4 whereof particular, said body is designed to be particularly rigid so as to resist flexing so as to essentially transmit all of said load onto said art object 22 which should hold said art object in place. Even more particular is the area of contact of said body 4 on said art object whereof most importantly so as to create an acceptable ratio of force to area, typically measured as psi, which shall comprise a force high enough to secure said art object in place in any subsequent viewing position while producing a low psi that will not damage said art object nor create aesthetic defects. More particular, said embodiment is effectively held in equilibrium due to said generated latch spring force predetermined to be much lower than the opposing force produced by the picture frame embodiment. Meaning, the combined material properties of said frame shell 16, and said glaze 18 and said mat 20 shall, when assembled, provide substantial strength which shall easily resist bending or defection when said hardware component is installed therein. Further now with respect to said tongue 10 as best depicted in FIG. 10, said tongue is under load, a dynamic condition as a result of being deflected a proximate predetermined distance upon installation. More particular, said tongue is particularly engineered to function independently as a leaf spring with its proximal end firmly integrated into said body 4 and with its distal end intimately contacting said mat 20. Even more particular, said compressive load within said tongue is then distributed directly onto said mat 20 such that the load is spread effectively in a low psi condition. More particular, force produced by tongue shall be high enough to firmly compress said mat 20 onto said glaze 18 which in turn shall be effectively sealed tightly against said frame shell rabbet 24 while said ratio of force to area shall be such that risk of damage to or visible imperfection in said mat is mitigated. Further now with respect to each pad 8 of which is best depicted in FIG. 10. Each said pad is configured as a particularly compliant leaf spring so as to maintain intimate contact with said art object while acting independently when under load as a result of being deflected upon installation. In particular, each said pad proximal end shall be integrated into said body 4 so as to transition along flat surface of said art object 22 in that each said pad distal end shall intimately contact said art object. With attention to particular distance and surface area design parameters said distal ends are to be configured to provide a most effective holding force at a most particular predetermined distance from said body 4. Most particular, said force produced by tongue shall be distributed most evenly to firmly compress said art object 22 onto said mat 20 without creating visible variations easily interpreted as defects in final assembly. To accomplish said most particular load distribution by said pad onto said art object, a most particular said force to area ratio shall again be effectively employed to effectively hold said art in place while mitigating risk of damage or visible imperfection of said art object. Even more further, with said particularly effective load distribution being at a substantial distance proximate to corner of said assembly said pad load distribution should effectively seal tightly, without any noticeable imperfection, said art object 22 against said mat 20 against said glaze 18 against said frame shell 16 so as to mitigate risk of damage to or visible imperfection in said art as well as entire said picture frame assembly.

With respect to positioning said art object for optimal viewing location, said effective force management resulting in particularly effective low force to area ratio, allows user to easily reposition said art object after final installation simply by sliding said art object laterally in any direction while under full load which eliminates need to measure and or mark said mat to center or particularly position said art object prior to or during assembly process.

To reduce cost of material, finishing, manufacturing, packaging and shipping the invention is best manufactured by the plastic injection molding process.

Figure 18:
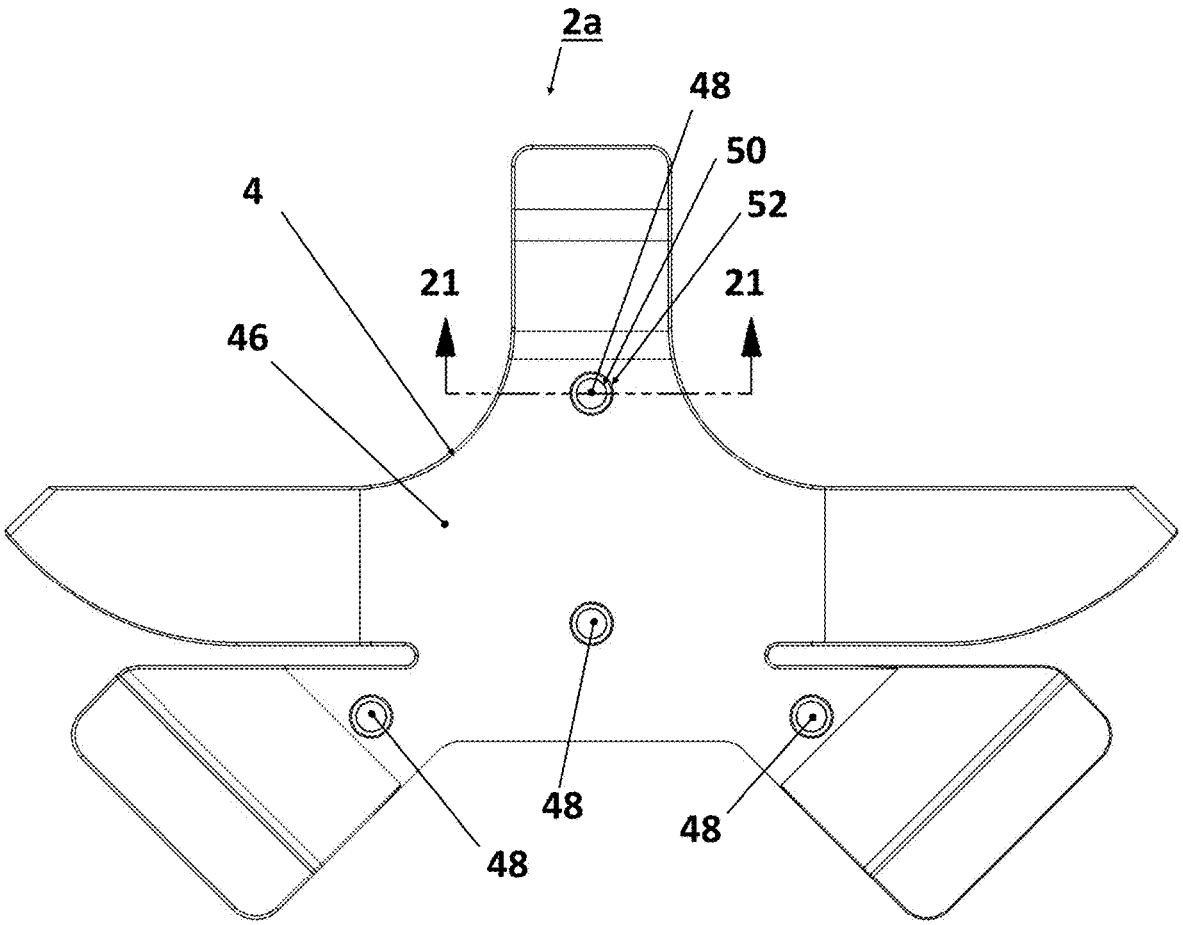
FIG. 18 is a bottom plan view of the component of FIGS. 1, 2, 3 and 4 to identify the predetermined specification of recessed ejector pin witness lines according to this location.
Figure 19:
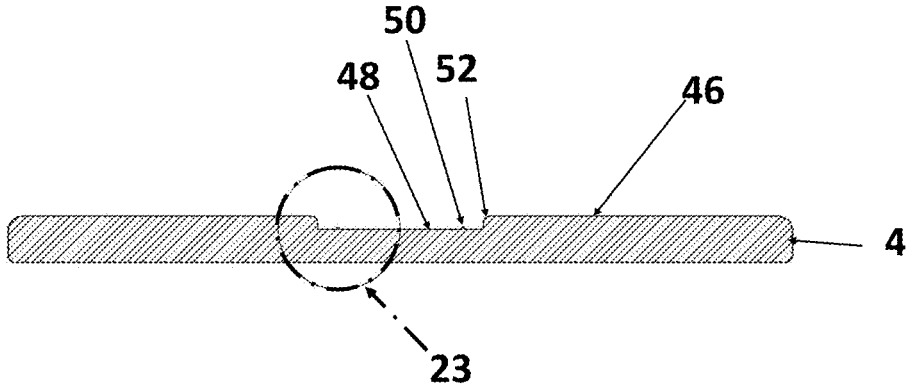
FIG. 19 is a cross sectional view of the component as depicted along line 21-21 in FIG. 18. In particular, the view focuses on the detail related to the recessed ejector pin specification according to the invention. As it is a "slice section", irrelevant lines have been removed for clarity. More particular, the view scale is 8:1.
Figure 20:
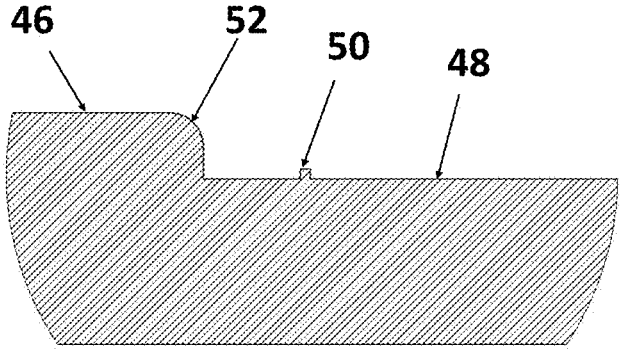
FIG. 20 is a detailed view of the area identified by line 23 in FIG. 19. In particular, the view is enlarged at scale 20:1 to enable better viewing of the detail of the recessed ejector pin area and particularly the witness line feature according to the invention.

With respect to injection molding the invention plastic body it must be ejected or pushed from the mold by using round ejector pins—simply an inherent part of the injection mold-making process. The nature of the mold construction and process produces a mark technically referred to as a witness line on the plastic component. That witness line is often uneven with raised sharp edges. Designers often struggle with where to locate the ejector pins for performance and aesthetic requirements. The invention requirements dictate the ejector pins must be on the side of said body 4 that contacts the art object, which is the bottom surface 46 as depicted in FIG. 18 whereon any sharp protrusion such as a witness line potentially creates a high risk of scratching said art object during installation. To eliminate said risk the invention incorporates a unique design feature that specifies to the mold maker to configure said mold ejector pins so to produce, with reference to FIG. 19 and FIG. 20, recessed ejector pin configurations. In particular, the surface 48 resembling the bottom surface of a counterbore type feature which is located a predetermined distance below said bottom surface 46. Thus, the resulting witness line 50 is created far enough below said bottom surface to effectively eliminate risk of damage to said artwork object. Additionally, a smooth radius 52 shall be applied to edge surrounding said recessed counterbore. to essentially eliminate all risk of said ejector pin configuration damaging said art object. It is important to note that the recessed ejector pin feature also contributes to cost reduction and increased quality assurance by eliminating need to trust the mold operator to polish the witness line smooth on every part.

With respect to mitigating risk of damage to said art object by way of contact with particular materials, said component is molded using particular plastic resin material recommended by experts in general care and storage of photographs particularly in accordance with guidelines set forth by the Society of American Archivists (SAA) wherein particular inert—chemically inactive—materials are recommended.

Figure 6:
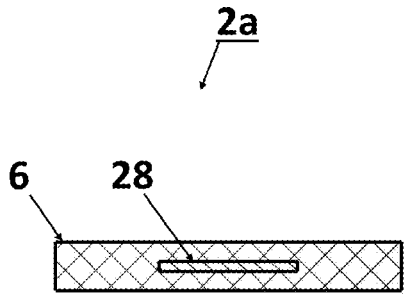
FIG. 6 is a cross sectional view of component of FIGS. 1,2, 3 and 4 along line 7-7 in FIG. 3. In particular, lines not pertaining to over-mold according to this invention, have been removed for clarity.
Figure 13:
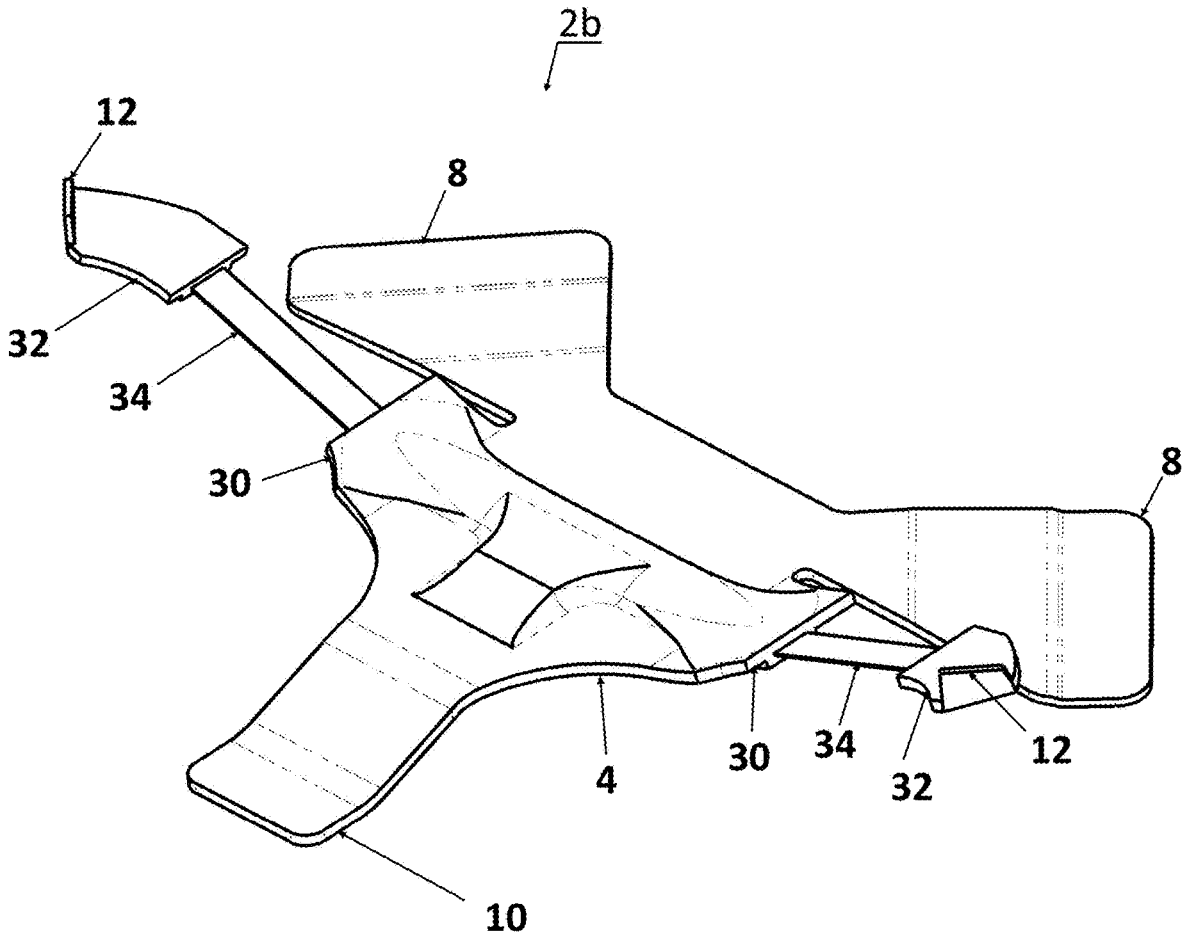
FIG. 13 is an isometric view of a second embodiment of the invention wherein spring steel components are insert molded so to effectively bridge the gap between the plastic proximal and plastic distal ends of the large leaf spring latches according to this invention.

Mitigation of risk of plastic deformation due to compressive loading is accomplished by employing the conventional over-molding plastic injection molding process. In particular, with reference to FIG. 6, spring steel 28 is over-molded to prevent plastic deformation from causing failure of said picture frame assembly. Additionally with reference to FIG. 13 a second embodiment 2*b* of the invention mitigates risk of plastic deformation due to compressive loading by employing the conventional insert molding process wherein spring steel parts 34 are particularly inserted so as to effectively replace a section of each said leaf spring latch at a predetermined location between the proximal end 30 and the distal end 32 of said leaf spring.

Figure 16:
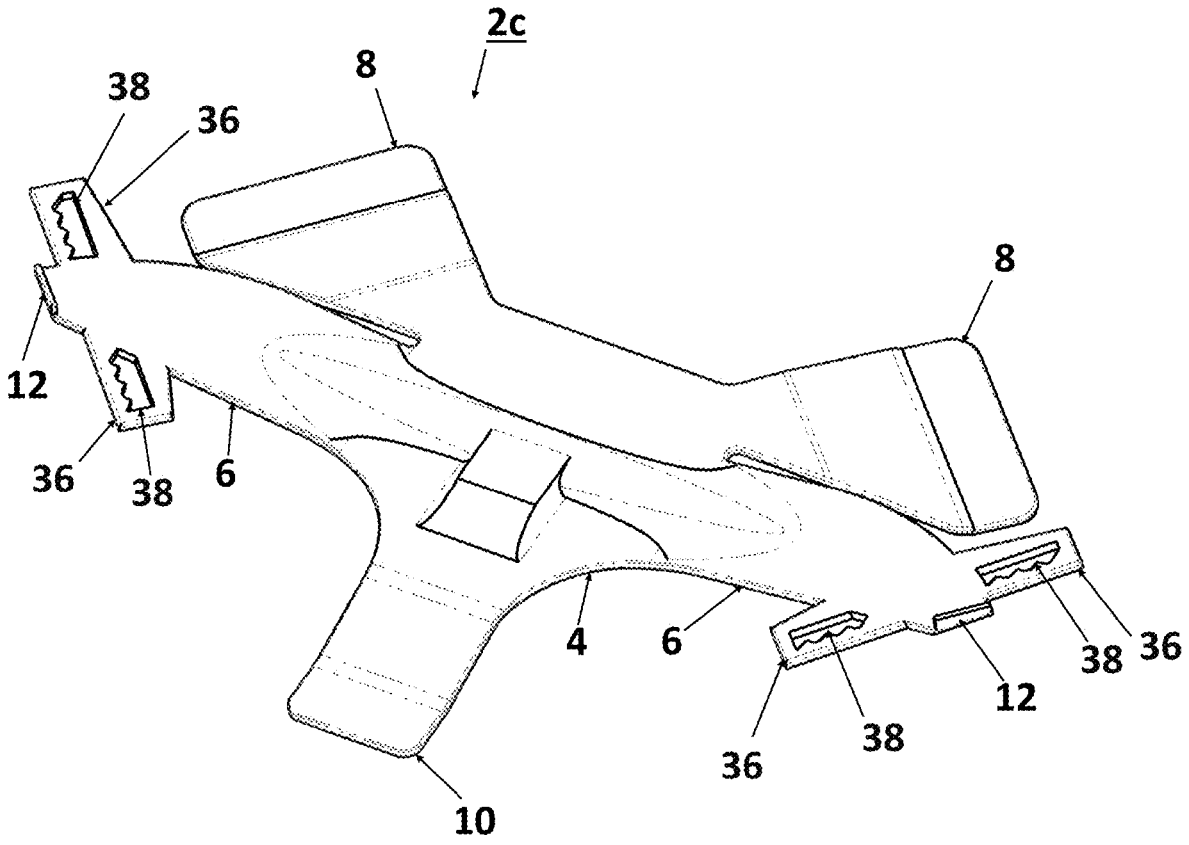
FIG. 16 is a plan view of a third embodiment of the invention particularly configured to provide picture hanging performance according to this invention.
Figure 17:
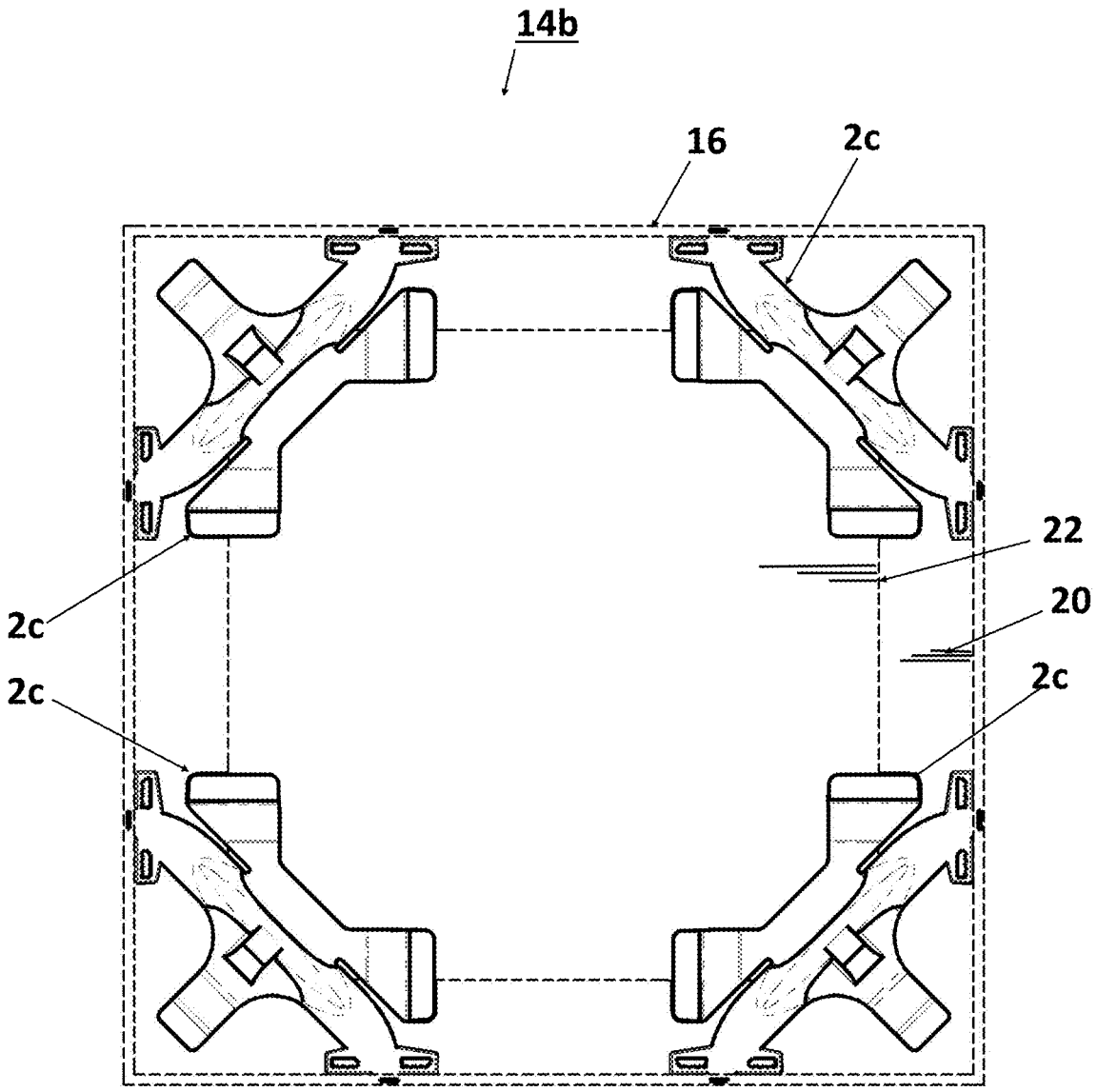
FIG. 17 is a plan view of a picture frame assembly wherein the third embodiment of the component of FIG. 16 is shown installed according to this invention.

With reference to FIG. 16 a third embodiment of invention 2*c* is depicted comprising an appendage 36 integrated on either side of said distal end of each said leaf spring latch wherein each aperture 38 is particularly configured to facilitate hanging said picture frame assembly on a vertical surface. With reference to FIG. 17 said third embodiment of the invention is shown installed within each corner of a picture frame assembly embodiment 14*b*.

Figure 14:
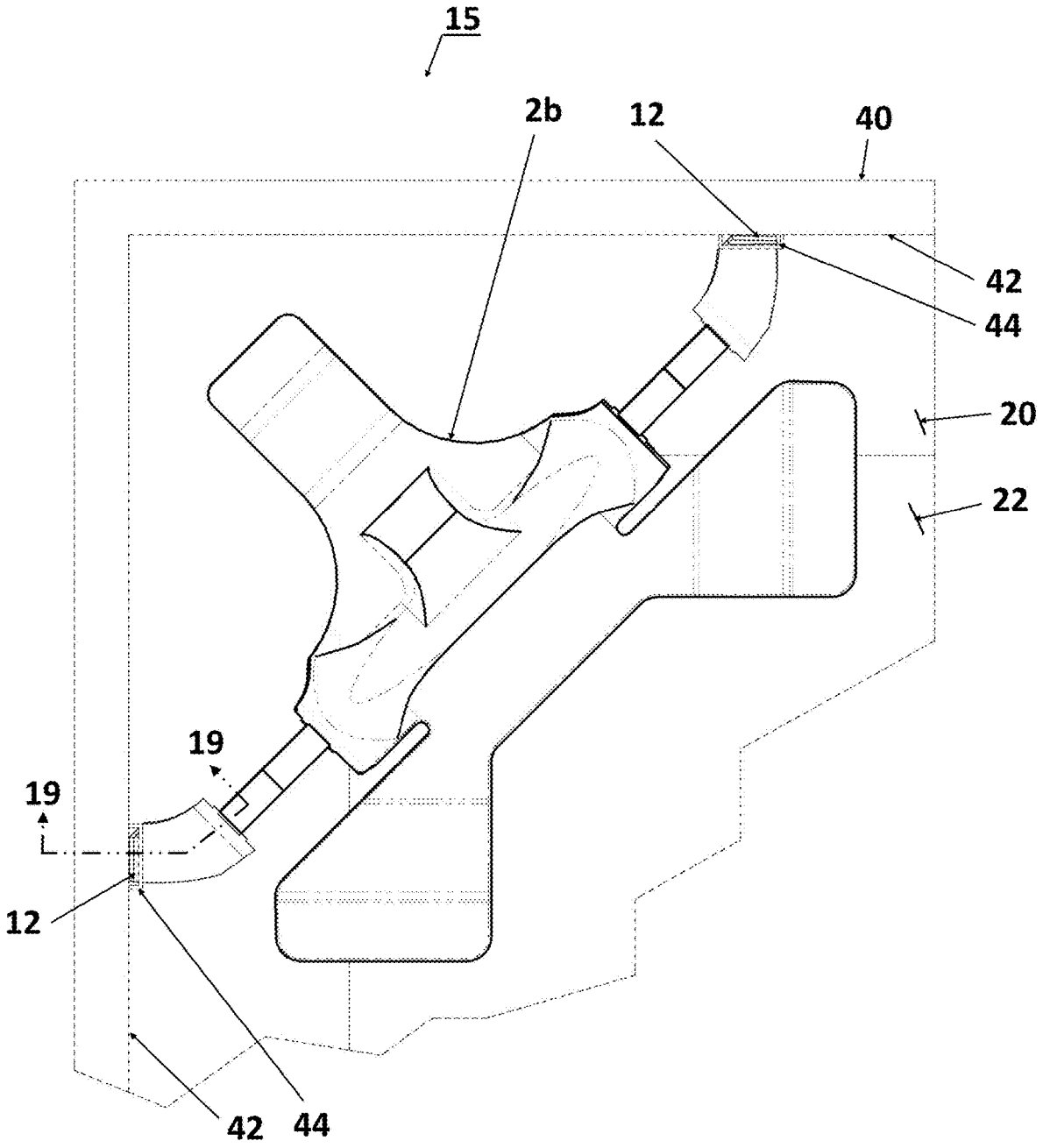
FIG. 14 is a partial plan view of a picture frame assembly wherein the second embodiment of the component of FIG. 11 is shown installed according to this invention.
Figure 15:
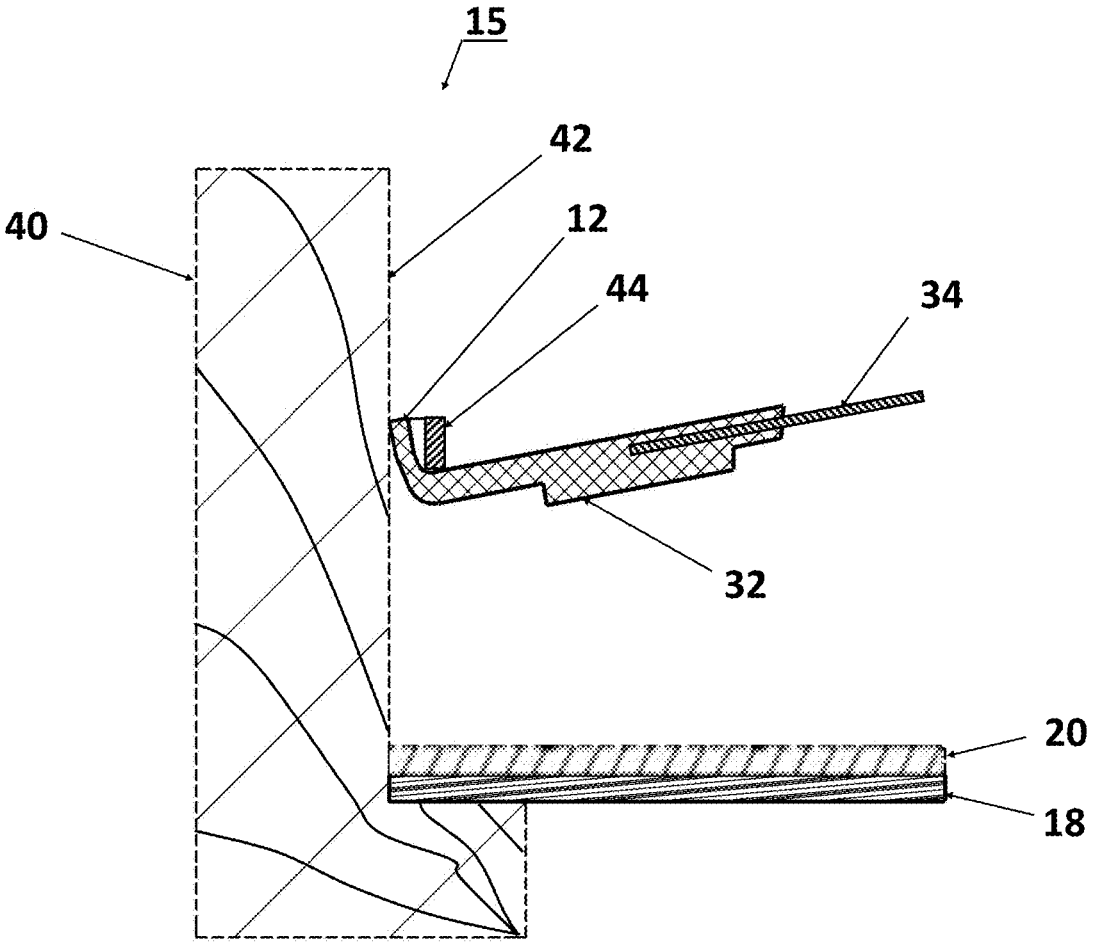
FIG. 15 is an elevational view, in partial section along line 19-19 in FIG. #14 depicting the second embodiment of the component of FIG. 13 as it is fully installed according to this invention.

With reference to FIG. 14 said second embodiment of invention 2*b* is depicted installed into a second picture frame assembly embodiment 15 particularly unlike said picture frame shell 16 whereof frame shell 40 is configured with only a rabbet 42 with no dado slot to captivate said leaf spring rib, thus prohibiting installation of said picture frame hardware component. Therefore, to facilitate installation of said component a common staple 44 is installed into said rabbet wall at a predetermined location relative to corner of picture frame assembly in a plan view and additionally depicted in elevational, partial sectional view FIG. 15.

The preferred embodiment described herein fulfills the objects of the invention. An inexpensive component for quickly retaining a wide variety of common objects considered art in a typical back-loading picture frame assembly, particularly behind a mat with no need to pre-locate, has been disclosed.

The invention has been described with particular reference to the preferred embodiments, but it will be understood that variations and modifications within the spirit and scope of the invention may occur to those skilled in the art to which the invention pertains.

What is claimed is:

1. A picture framing hardware component for retaining art objects behind a mat in back-loading picture frames comprising:

a main support body configured to remain relatively inflexible while comprising a plurality of leaf spring appendages whereof each proximal end is integrally part of said body extending outward with each having distal ends particularly configured to contact and apply a particular predetermined load onto particular components within a polygonal picture frame assembly particularly comprising a frame shell configured with an integral rabbet and an integral dado or said dado particularly configured by installer, mat panel with an aperture, glaze panel and art object and;

a pair of said appendages, particularly leaf spring latches contact said frame shell upon assembly so as to provide primary compressive force transmitted to;

said main support body which, in particular, contacts and safely distributes load directly upon said art object resulting in an opposing force holding said assembly system in equilibrium;

and at least one leaf spring appendage, particularly identified as a tongue is configured such that its distal end directly contacts and applies loading to said mat and;

a pair of leaf spring appendages particularly identified as pads configured such that each respective distal end is particularly engineered to provide intimate contact with said art object so as to most effectively distribute a compressive load safely.

2. The picture framing hardware component of claim 1 wherein said main support body is particularly configured to have beam strength of greater value than combined beam strength of all said appendages integrated as part of or attached to said body so as to configure said body to resist bending upon installation.

3. The picture framing hardware component of claim 1 whereupon each said latch distal end is configured with a particular rib to facilitate captivation within said dado slot integrated within or attached to said picture frame shell so as to prevent accidental dislodging of leaf spring distal ends from frame shell so as to mitigate risk of failure of said picture frame assembly.

4. The picture framing hardware component of claim 1 wherein over-molding is utilized to manufacture said component so as to mitigate risk of failure due to plastic deformation due to compressive loading.

5. The picture framing hardware component of claim 1 wherein insert molding is utilized to manufacture said component so as to mitigate risk of failure due to plastic deformation due to compressive loading.

6. The picture framing hardware component of claim 1 manufactured using inert plastic resin to mitigate risk of damage to said art objects.

7. The picture framing hardware component of claim 1 configured with appendages on one or both sides of latch distal ends where said appendages are configured so as to facilitate hanging said picture frame assembly on a vertical support structure.

* * * * *